US007182128B2

(12) United States Patent
Yu et al.

(10) Patent No.: US 7,182,128 B2
(45) Date of Patent: Feb. 27, 2007

(54) HEAT EXCHANGER TUBE HAVING STRENGTHENING DEFORMATIONS

(75) Inventors: Wen F. Yu, Ann Arbor, MI (US); Peter Fredrickson, Troy, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 32 days.

(21) Appl. No.: 11/076,007

(22) Filed: Mar. 9, 2005

(65) Prior Publication Data

US 2006/0201665 A1 Sep. 14, 2006

(51) Int. Cl.
*F28F 1/06* (2006.01)
*B23P 15/26* (2006.01)

(52) U.S. Cl. ..... 165/177; 29/890.053

(58) Field of Classification Search ..... 165/172, 165/173, 177, 152, 153; 29/890.03, 890.053
See application file for complete search history.

(56) References Cited

U.S. PATENT DOCUMENTS

| | | | | |
|---|---|---|---|---|
| 2,149,696 | A | 3/1939 | Holmes | |
| 2,252,045 | A * | 8/1941 | Spanner | 165/177 |
| 3,750,709 | A | 8/1973 | French | |
| 3,786,653 | A | 1/1974 | Blomberg | |
| 4,314,587 | A | 2/1982 | Hackett | |
| 4,353,415 | A | 10/1982 | Klaschka et al. | |
| 4,470,452 | A * | 9/1984 | Rhodes | 165/153 |
| 4,558,695 | A | 12/1985 | Kumazawa et al. | |
| 4,690,211 | A * | 9/1987 | Kuwahara et al. | 165/177 |
| 4,982,784 | A | 1/1991 | Rhodes | |
| 5,105,540 | A | 4/1992 | Rhodes | |
| 5,184,674 | A | 2/1993 | Keyes | |
| 5,586,598 | A | 12/1996 | Tanaka et al. | |
| 5,655,599 | A | 8/1997 | Kasprzyk | |
| 5,791,405 | A | 8/1998 | Takiura et al. | |
| 5,890,288 | A * | 4/1999 | Rhodes et al. | 29/890.053 |
| 5,934,128 | A | 8/1999 | Takiura et al. | |
| 6,026,892 | A | 2/2000 | Kim et al. | |
| 6,298,909 | B1 | 10/2001 | Fukatami et al. | |
| 6,510,870 | B1 * | 1/2003 | Valaszkai et al. | 165/183 |
| 6,533,030 | B2 | 3/2003 | Mitrovic et al. | |
| 7,011,150 | B2 * | 3/2006 | Komatsubara et al. | 165/177 |
| 2001/0006106 | A1 | 7/2001 | Beutler et al. | |
| 2003/0010485 | A1 | 1/2003 | Goldman et al. | |
| 2005/0161208 | A1 * | 7/2005 | Sucke et al. | 165/177 |

FOREIGN PATENT DOCUMENTS

| | | | |
|---|---|---|---|
| DE | 102 25 812 | C1 * | 8/2003 |
| JP | 03170797 | A | 7/1991 |

* cited by examiner

*Primary Examiner*—Teresa J. Walberg
(74) *Attorney, Agent, or Firm*—Brinks Hofer Gilson & Lione

(57) ABSTRACT

A heat transfer tube for a heat exchanger and a method of manufacturing such a tube. The heat transfer tube includes opposing top and bottom walls and end walls connecting the top and bottom walls to each other. The top and bottom walls each define a substantially planar surface and the end walls each define a generally curved surface. The end walls each including deformations formed therein to strengthen the heat transfer tube.

18 Claims, 6 Drawing Sheets

HEAT EXCHANGER TUBE HAVING STRENGTHENING DEFORMATIONS

BACKGROUND

1. Field of the Invention

The present invention relates generally to a heat exchanger. More specifically, the present invention relates to a heat transfer tube for a heat exchanger.

2. Related Technology

Heat exchanger assemblies, such as radiators, heater cores, and condensers, for automotive vehicle powertrain cooling and air conditioning systems typically include a pair of headers and a core having a plurality of tubes disposed horizontally between the two headers. Within the headers, partitions divide the interior space of the headers into multiple, fluidly separate spaces. As a result, refrigerant passing through the heat exchanger is caused to flow generally horizontally along the length of the tubes, in a serpentine fashion, making more than one pass between the headers. A plurality of thin heat exchange fins extend generally vertically from the top and bottom surfaces of the tubes to increase the surface area of heat exchanging components.

During operation of the heat exchanger, air flows across the exterior of the tubes and between the fins in a direction generally perpendicular to the length of the tubes. In order to maximize the heat exchange between the fins and the air flowing therethrough, the fins and the tubes have an increased width in the direction parallel to the airflow. Additionally, to decrease the wind resistance on the airflow, the tubes have a decreased thickness in the direction perpendicular to the airflow. Thus, the tubes preferably have a generally oblong shape with relatively small end faces and relatively large top and bottom faces.

The non-circular cross-section of the tubes, however, may cause non-constant stress along the perimeter of the tubes. More specifically, the oblong configuration causes increased stress in the curved areas between the end faces and the top and bottom faces. Therefore, the tubes may be subject to premature part failure along these increased stress areas.

Furthermore, the walls of the tubes have a minimum thickness to maximize heat exchange between the refrigerant and the airflow. Thus, it may be undesirable to increase the thickness of the tube walls to compensate for potential increased stress areas.

Therefore, it is desirable to provide heat exchange tubes having enhanced strength and a method of manufacturing such tubes.

SUMMARY

In over coming the drawbacks and limitations of the known technology, a heat transfer tube is provided having opposing top and bottom walls connected by end walls to each other. The top and bottom walls each define a substantially planar surface and the end walls each define a generally arcuate surface. Furthermore, the end walls each include a plurality of deformations to strengthen the heat transfer tube. More specifically, the deformations include a recess or concave depression on the exterior surface of the tube.

In another aspect, the deformations extend in a generally linear direction along the end walls. More specifically, the deformations extend along the end walls at an angle between 15 and 165 degrees with respect to a longitudinal axis of the tube. Even more specifically, the angle is between 15 and 75 degrees or between 105 and 165 degrees with respect to the longitudinal axis.

In yet another aspect of the present invention, the concave depressions have a deformation height that is substantially equal to the tube thickness, generally between 0.05 and 1.5 millimeters.

In still another aspect of the present invention, the tube is formed of a metal sheet having a pair of end portions. The sheet is folded back upon itself to define a passageway therein and the end portions meet at and extend across the passageway so as to contact an inner surface of the sheet opposite thereof. This construction strengthens the heat transfer tube. Alternatively, only one of the two end portions may extend across the passageway to contact the inner surface opposite thereof. This end portion may exhibit a generally arcuate cross-section so as to provide a spring-like characteristic to the tube.

In another aspect, the present invention is provided as a heat exchanger for a vehicle HVAC system. The heat exchanger includes a core utilizing a series of tubes to extend between a pair of headers and to facilitate heat exchange from a fluid flowing through the heat exchanger.

A method of manufacturing the tube and heat exchanger is also provided. The method includes the steps of: forming a plurality of deformations in a sheet material, forming opposing top and bottom walls such that each of the top and bottom walls defines a substantially planar surface, and forming end walls connecting the top and bottom walls to each other. The end walls having a generally arcuate surface and the plurality of deformations being defined therein.

Further objects, features and advantages of this invention will become readily apparent to persons skilled in the art after a review of the following description, with reference to the drawings and claims that are appended to and form a part of this specification.

DETAILED DESCRIPTION

Figure 1:
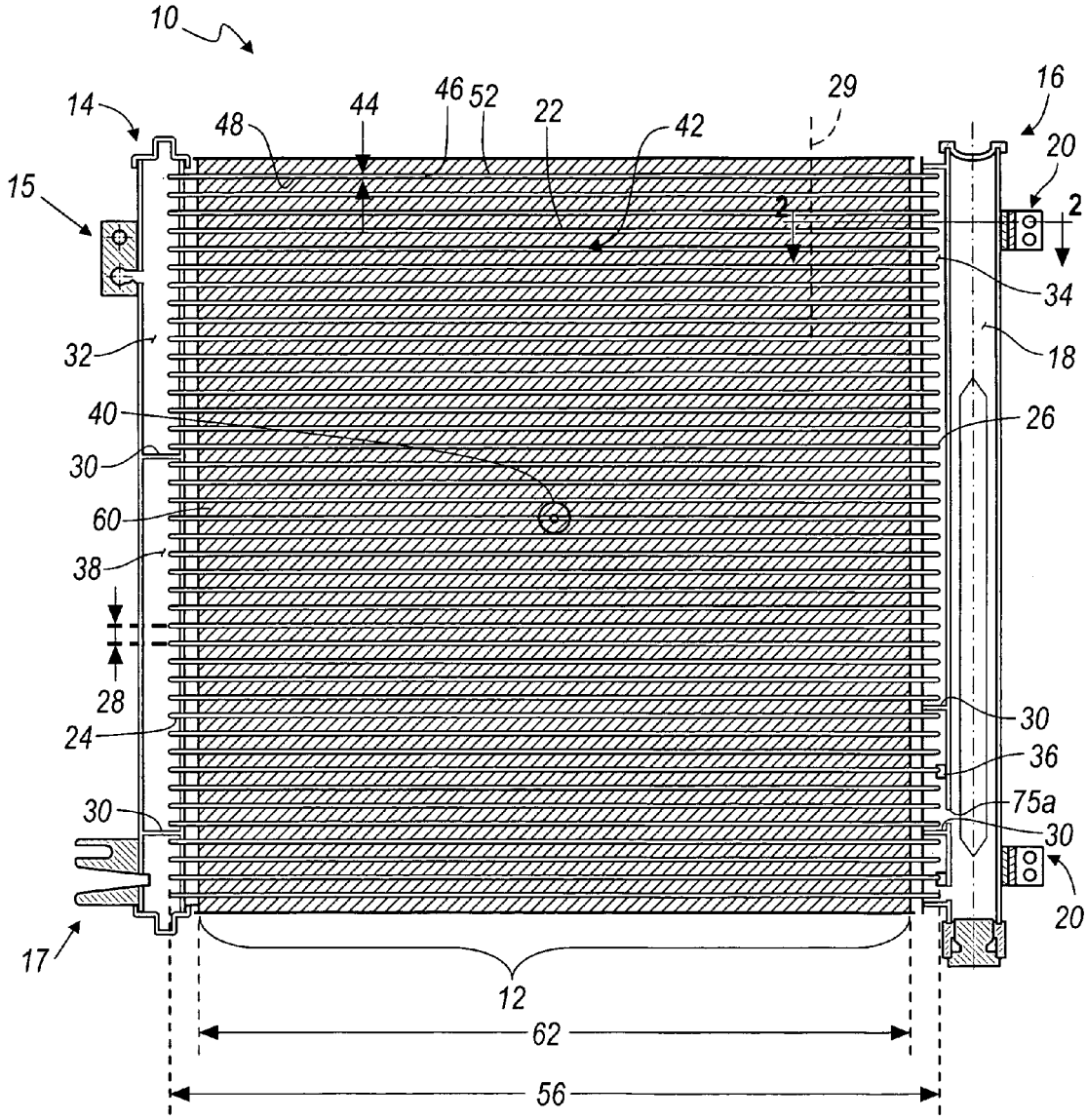
FIG. 1 shows a plan view of a heat exchanger of a motor vehicle embodying the principles of the present invention.

Referring now to the drawings, FIG. 1 shows a heat exchanger assembly 10 embodying the principals of the present invention. More particularly, the heat exchanger assembly 10 in FIG. 1 is a condenser for an air conditioning circuit in an automobile. Alternatively, the heat exchanger assembly may be a radiator, a heater core, or any other suitable heat exchanger. Furthermore, the heat exchanger may be used in conjunction with any suitable field of invention.

The heat exchanger assembly 10 includes a core 12 with first and second headers 14, 16 located on opposing ends. The first header 14 is provided with an inlet 15 at its upper end and an outlet 17 at its lower end. Within the header 14 are one or more baffles 30 that divide the header 14 into fluidly separate spaces. The second header 16 is an integrated header having a manifold and a receiver/dryer tube 18 with features that remove unwanted water from the refrigerant, as is generally known in the art. The heat exchanger 10 may further include a pair of brackets 20 to mount the heat exchanger 10 to the vehicle (not shown) during use in an air conditioning system (not shown).

The core 12 itself is a tube stack comprised of a series of tubes 22 extending between the headers 14, 16. More specifically, a first end 24 of the tubes 22 extend into openings in the first header 14 and a second end 26 of the tubes 22 extend into openings in the second header 16. The tubes 22 are generally parallel and vertically stacked with respect to each other. The tubes 22 are also generally evenly-spaced apart from one another such that a space 28 is defined therebetween.

Provided as described above, the first and second ends 24, 26 of the tubes 22 are in fluid communication with the first and second headers 14, 16. Therefore, refrigerant received into the first header 24 flows through the passageway 31 defined by the tubes 22 and into the second header 26. As mentioned above, the baffles 30 divide the headers 14, 16 into respective chambers 32, 34, 36, and 38 and as a result, the refrigerant is caused to flow back and forth across various tubes 22 and between the headers 14, 16 in a generally serpentine fashion.

During operation of the heat exchange assembly 10, air flows across the core 12 in an airflow direction into the drawing as generally indicated by arrow 40. The airflow removes heat from the refrigerant that is flowing through the tubes 22 causing it to cool and condense.

Figure 2:
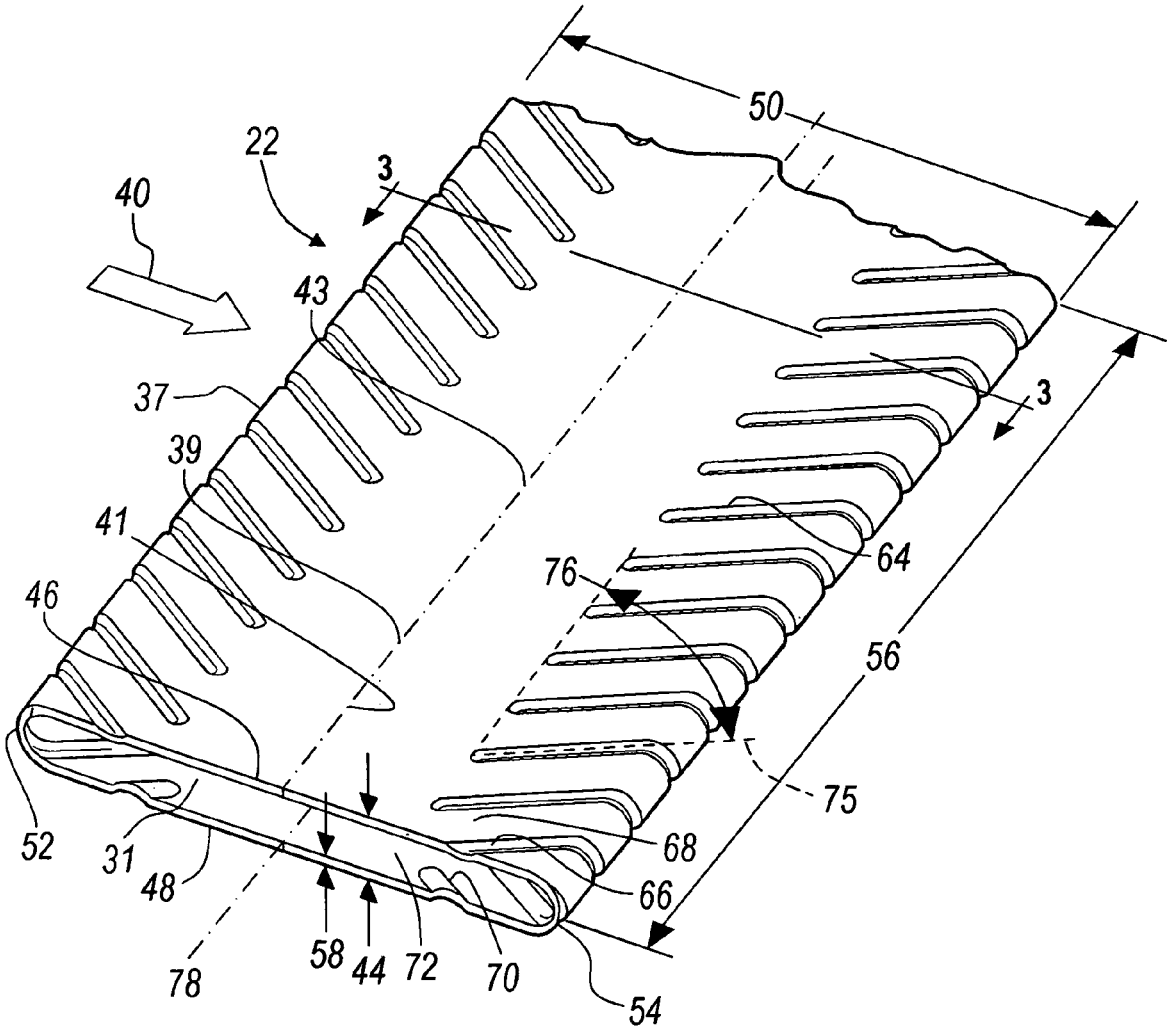
FIG. 2 is an enlarged, partial perspective view of a heat transfer tube embodying the principles of the present invention.

Referring to FIG. 2, the tubes 22 are generally oblong shaped and include portions defining one or more flow passageways 42 longitudinally through the tube 22. The tubes 22 have a tube height 44 defined by the distance between a top wall 46 and a bottom wall 48 of the tubes 22. Additionally, the tubes 22 include a tube width 50 defined by the distance between a front end wall 52 and a back end wall 54, that are respectively generally normal to the airflow direction 40. A tube length 56 is defined between the respective headers 14, 16, in a direction substantially perpendicular to the airflow direction 40.

The tubes 22 are formed from a sheet 37 of material, such as sheet metal, having first and second edges 39, 41. The sheet 37 is bent back upon itself such that the edges 39, 41 extend towards and engage each other to form a seam 43 generally at the middle or longitudinal axis 78 of the tube 22. The edges 39, 41 are connected to each other along the seam 43 by any appropriate technique such as welding.

In order to maximize the space 28 between adjacent tubes 22, and minimize the portion of the core 12 that obstructs the airflow through the core, the tube height 44 is substantially less than the tube width 50. Additionally, to provide effective mating surfaces for heat transfer promoting components, such as those described below, and to simplify manufacturing steps, the top and bottom walls 46, 48 are both preferably planar and parallel with each other. Furthermore, to maintain a generally smooth flow through the core 12 and to simplify manufacturing steps, the front and back end walls 52, 54 are arcuate with substantially constant radii of curvature. Also to simplify manufacturing steps, the tubes 22 have a substantially constant wall thickness 58 at all four walls 46, 48, 52, and 54.

Located within the space 28 between each adjacent tube 22 is a fin 60 that increases heat transfer between the tubes 22 and the airflow intersecting the heat exchanger assembly 10. The fins 60 exhibit a generally corrugated shape or a series of convolutes, as is commonly known in the industry, that extend substantially completely across the space 28 between adjacent tubes 22. A series of louvers may be provided on each corrugation of the fins 60 in order to further aid in heat transfer to the air passing therethrough. Preferably, the fins 60 also extend substantially completely across the tube width 50.

Figure 3:
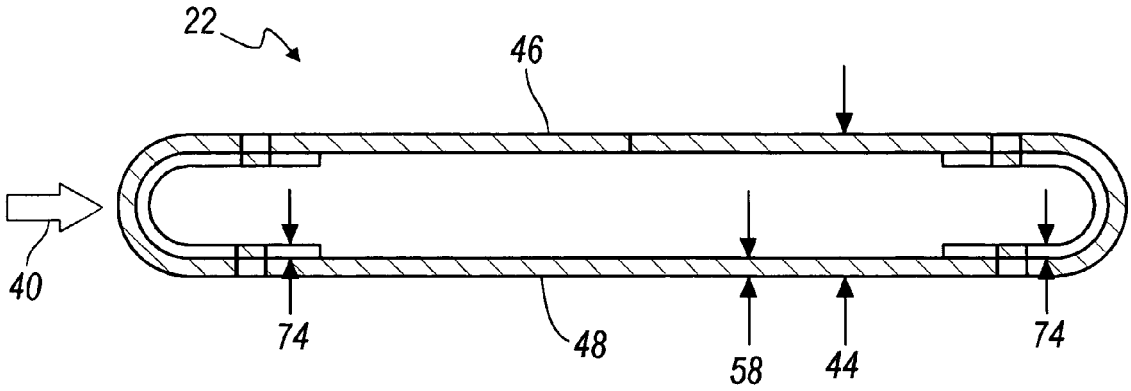
FIG. 3 is a cross-sectional view, generally taken along line 3—3 in FIG. 2, showing the deformation thickness and the tube thickness.

Referring now to FIGS. 2 and 3, a plurality of deformations 64 are formed in the tubes 22 to strengthen the tubes 22. More specifically, the deformations 64 are formed as concave indentations or recesses in the exterior surface 68 of the tubes 22 and corresponding convex ridges on the interior surface 72 of the tubes 22. The deformations 64 have a deformation thickness 74 that is substantially equal to the tube wall thickness 58.

The deformations 64 extend in a direction 75 that forms an angle 76 with regard to a longitudinal axis 78 of the tubes 22. The direction 75 is preferably not parallel to the longitudinal axis 78 so that the deformations 64 will not undesirably contact each other in the area adjacent to the end walls 52, 54. If provided perpendicular to the tube axis 78, the convex ridges formed by the deformations 64 may contact each other within the tube 22 and restrict refrigerant flow. Therefore, the angle 76 is preferably greater than 15 degrees and less than 165 degrees.

Furthermore, the direction 75 is preferably not perpendicular with the longitudinal axis 78 because the deformations 64 may cause turbulent refrigerant flow through the tubes 22 in the area adjacent to the front and back surfaces 52, 54. More specifically, ridges perpendicular to the flow may cause the refrigerant to have a turbulent, sinusoidal flow, rather than a smooth, vortex flow caused by deformations 64 having another angle. Therefore, the angle is more preferably between 15 and 75 degrees or between 105 and 165 degrees with respect to the longitudinal axis.

Figure 4:
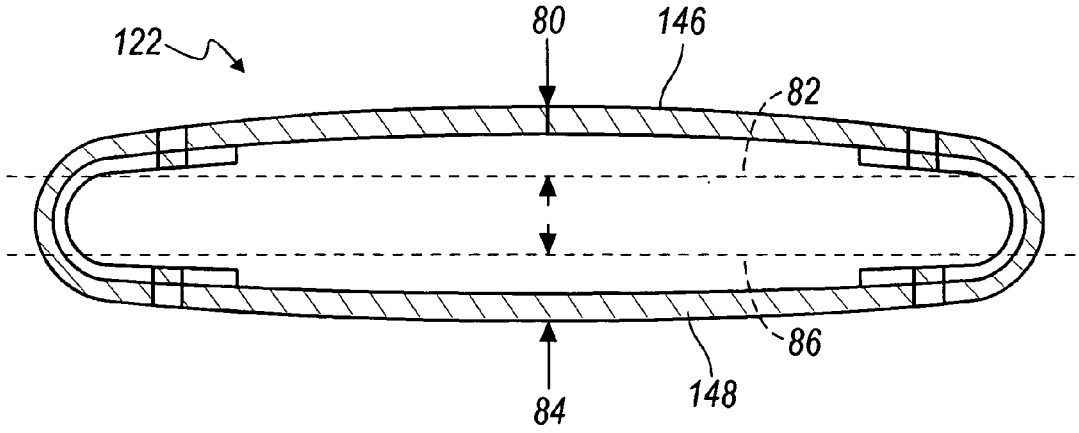
FIG. 4 is a cross-sectional view, similar to the view shown in FIG. 3, of an alternative embodiment of the present invention.

Referring now to FIG. 4, an alternative embodiment of the present design is shown, where a tube 122 includes a top surface 146 and a bottom surface 148 that are not substantially parallel with each other. More specifically, the top surface 146 defines an outwardly-bowed shape that extends a distance 80 above a horizontal plane 82 drawn between the respective upper edges of the end walls 52, 54. Similarly, the bottom surface 148 defines an outwardly-bowed shape that extends a second distance 84 above a second horizontal plane 86 drawn between the respective lower edges of the end walls 52, 54.

The bowed surfaces 146, 148 cause a spring-like force between the respective surfaces 146, 148 and the fins 60 between adjacent tubes 22, thus improving the connection therebetween. More specifically, the fins 60 engage and force inwardly the bowed surfaces 146, 148, causing a secure engagement therebetween. Once the bowed surfaces 146, 148 are forced inwardly towards each other in this fashion, they become substantially parallel with each other.

Figure 5:
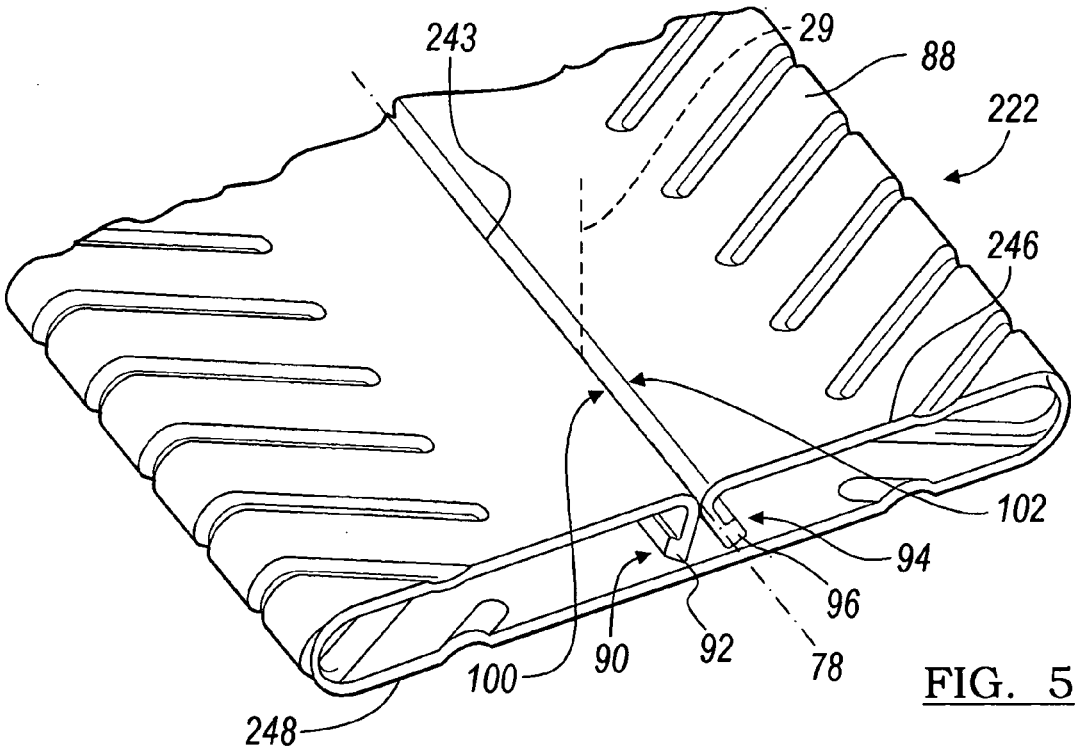
FIG. 5 is an enlarged partial perspective view of another alternative embodiment of the present invention, having a pair of strengthening portions extending across the passageway of the conduit.

Referring now to FIG. 5, an alternative embodiment of the present invention is shown, where a tube 222 is formed from a metal sheet 88 having a first end portion 90, a second end portion 94 and a seam 243 that is defined by bent portions 100, 102, adjacent the end portions 90, 94, respectively. The bent portions 100, 102 define angles of about 90 degrees such that the end portions 90, 94 extend from a top surface 246 towards the bottom surface 248 in a direction substantially perpendicular thereto. The terminal edges 92, 96 of the end portions 90, 94 engage an inner surface 104 of the bottom wall 248 and, as such, strengthen the tube 222 against collapse in its middle. The bent portions 100, 102 and the edges 92, 96 and the inner surface 104 are respectively connected to each other by an appropriate process, such as welding or brazing.

Figure 6:
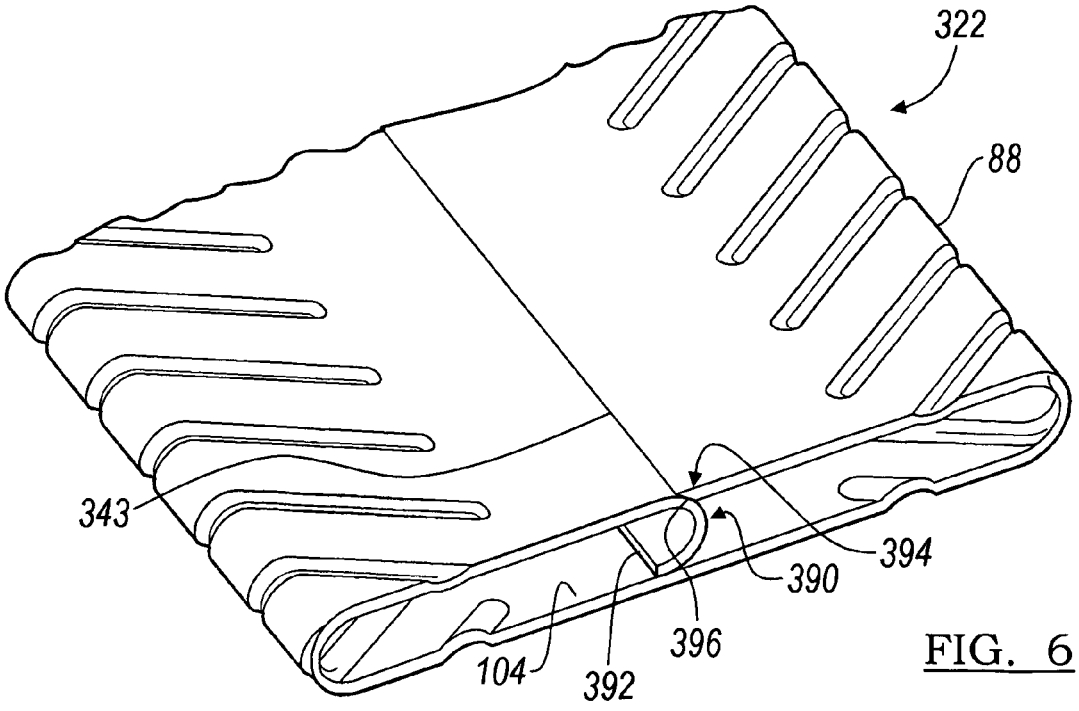
FIG. 6 is an enlarged partial perspective view of yet another alternative embodiment of the present invention, having an arcuate end portion extending across the passageway to strengthen the tube.

Referring now to FIG. 6, another alternative embodiment of the present invention is shown where a tube 322 is formed from a metal sheet 88 having a first end portion 390 and a second end portion 394. The first end portion 390 is a bent portion that curves and contacts the inner surface 104 of the tube 322. The second end portion 394 is generally linear and terminates in a second edge 396 that contacts the bent first end portion 390 to define a seam 343. The bent portion is thus able to stiffen the tube 322 against collapse, providing a spring-like effect by further bending when a sufficient vertical force is applied. Similarly to the design shown in FIG. 5, the second edge 396, the bent first end portion 390 and the inner surface 104 are respectively connected to each other by an appropriate means, such as welding or brazing.

Figure 7:
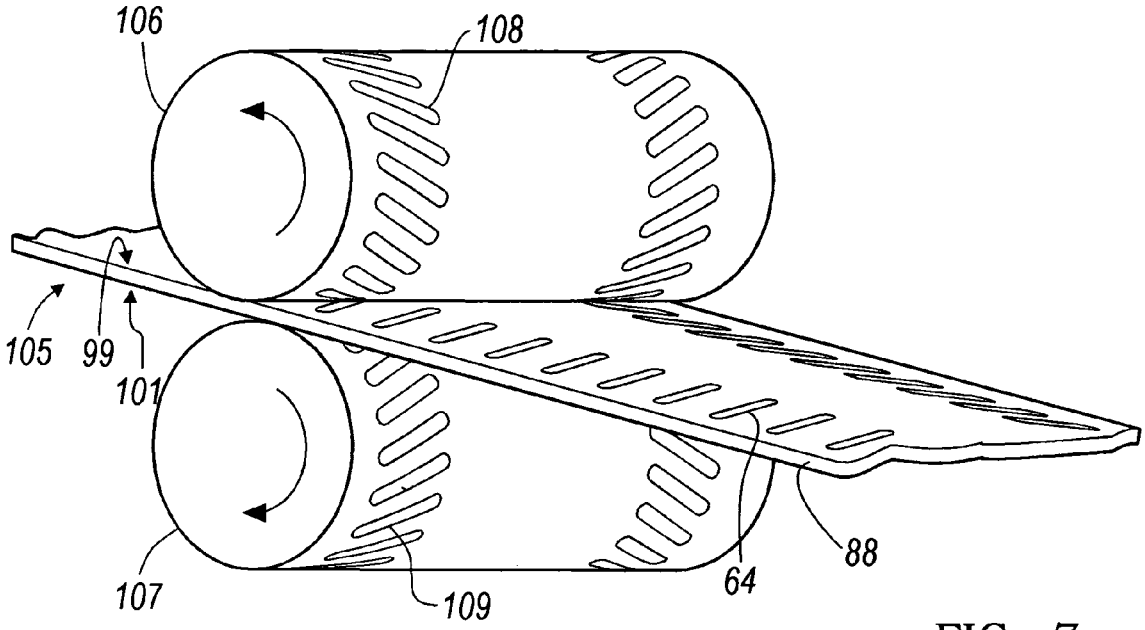
FIG. 7 is a schematic illustration showing an apparatus for forming the deformations in a sheet of material.
Figure 8:
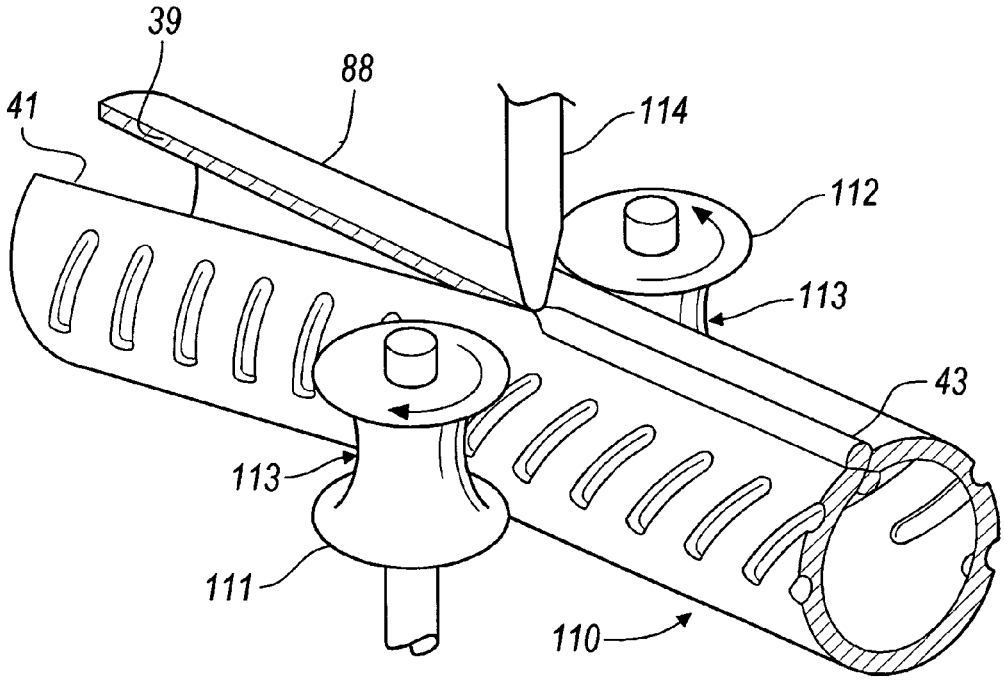
FIG. 8 shows a second apparatus for forming the sheet of material of FIG. 7 into a generally circular tube.
Figure 9:
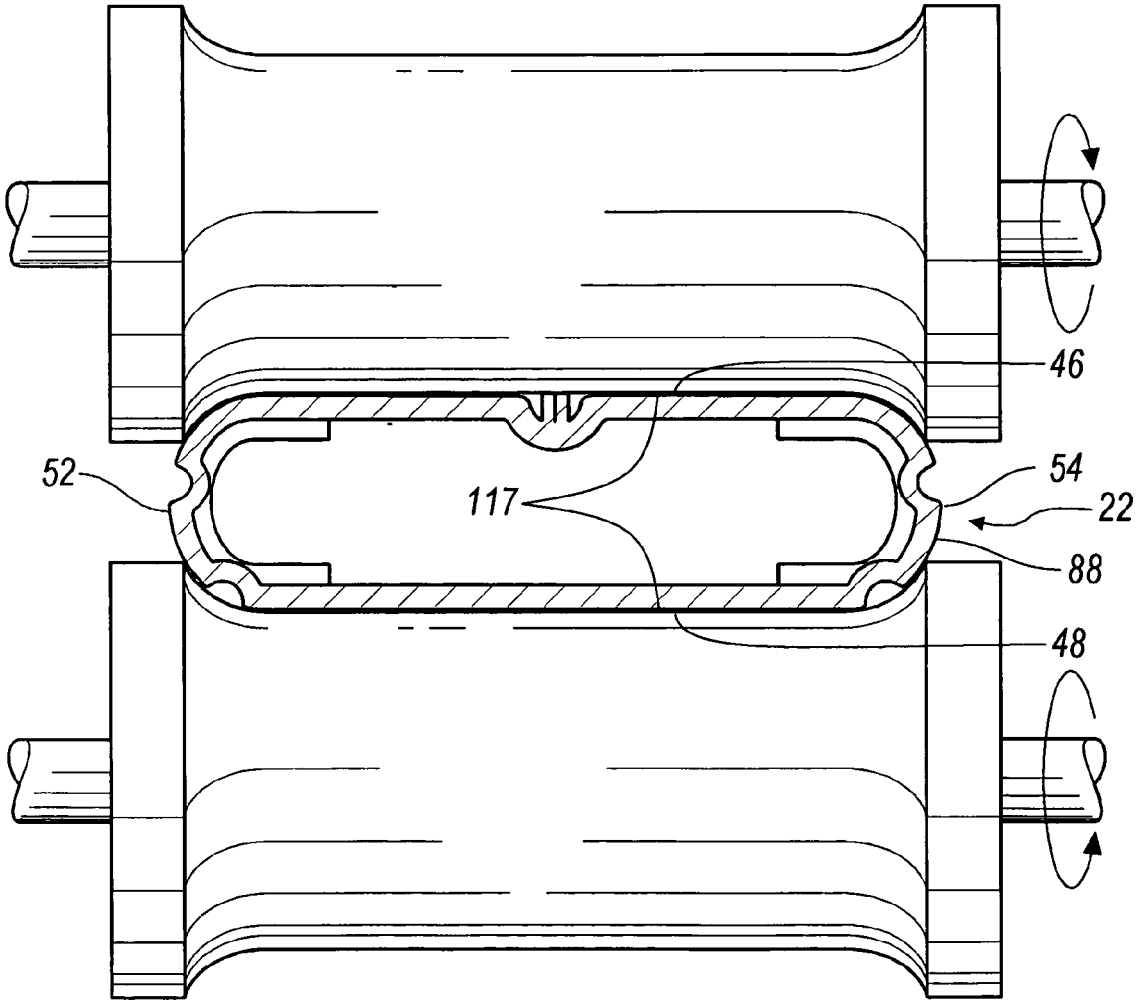
FIG. 9 shows a third apparatus for deforming the tube shown in FIG. 8 into an oblong-shaped tube.

Referring now to FIGS. 7–9, a process of manufacturing a tube as described above will now be discussed in more detail. First, a large, flat blank 105 of the metal sheet 88, having a top surface 99 and a bottom surface 101, is inserted between top and bottom deforming rollers 106, 107 to form the deformations 64. More specifically, the top roller 106, which contacts the top surface 99, includes a plurality of concave depressions 108 and the bottom roller 107, which contacts the bottom surface 101, includes a plurality of corresponding convex ridges 109. The depressions 108 and ridges 109 are equally spaced and similarly shaped, and the rollers 106, 107 rotate at an equal rate in opposite directions. Thus, the depressions 108 are continuously aligned with the ridges 109 such that the ridges 109 deform the bottom surface 101 upwardly while the corresponding depressions 108 receive the displaced material.

Next, as shown in FIG. 8, the respective edges 39, 41 are bent towards each other to mold the metal sheet 88 into a generally circular state 110. More specifically, left and right side rollers 111, 112 both rotate in opposite directions to feed the metal sheet 88 forward. The rollers 111, 112 have arcuate surfaces 113 to bend the edges 39, 41 towards each other to define a seam 43 and to form the circular state 110 of the metal sheet 88. A sealing means, such as a welding device 114, may be provided to connect the respective edges 39, 41 to each other along the seam 43.

Referring now to FIG. 9, the oblong-shaped tube 22 is next formed by compressing opposing sides of the circular state 110 metal sheet 88. More specifically, top and bottom rollers both rotate in opposite directions to feed the metal sheet 88 forward. The rollers have generally flat surfaces 117 to respectively deform the top and bottom surfaces 46, 48 of the metal sheet 88 towards each other. As the top and bottom surfaces 46, 48 converge towards each other, the front and back surfaces 52, 54 move away from each other and increase the width 50 of the tube 22.

The top and bottom rollers may alternatively have generally arcuate surfaces to form the tube 122 shown in FIG. 4 having bowed top and bottom walls 146, 148. Also, the rollers may alternatively be positioned along the sides of the circular state 110 metal sheet 88 such that the seam 43 is along either the front end walls 52 or the back end walls 54. Additionally, the tube 22 may be composed of an appropriate alternative material, such as plastic.

Furthermore, the tube 22 may also be formed by any other appropriate method, such as extrusion. In this alternative process, a blank of material is preferably extruded into the oblong shaped tube shown in the Figures. Next, the outer surface of the tube is deformed by an appropriate method, such as stamping, to form the deformations.

It is therefore intended that the foregoing detailed description be regarded as illustrative rather than limiting, and that it be understood that it is the following claims, including all equivalents, that are intended to define the spirit and scope of this invention.

What is claimed is:

1. A heat transfer tube for a heat exchanger, the heat transfer tube comprising:

opposing top and bottom walls, each of the top and bottom walls defining a substantially planar surface;

opposing end walls connecting the top and bottom walls to each other, each of the end walls defining a generally arcuate surface having a plurality of deformations formed therein, the deformations strengthening the heat transfer tube; and wherein the deformations extend around the end walls of the tube and into the top and bottom walls of the tube.

2. A heat transfer tube as in claim 1, wherein the deformations are generally linear.

3. A heat transfer tube as in claim 2, further comprising a longitudinal axis extending along the heat transfer tube, the deformations extending along the end walls at an angle of 15 degrees to 165 degrees with respect to the longitudinal axis.

4. A heat transfer tube as in claim 2, wherein the angle is between 15 and 75 degrees with respect to the longitudinal axis.

5. A heat transfer tube as in claim 2, wherein the angle is between 105 and 165 degrees with respect to the longitudinal axis.

6. A heat transfer tube as in claim 1, wherein the heat transfer tube defines a conduit and the deformations protrude into the conduit at a deformation height.

7. A heat transfer tube as in claim 6, wherein the heat transfer tube has a tube thickness and the deformation height is substantially equal to the tube thickness.

8. A heat transfer tube as in claim 6, wherein the deformation height is in the range of about 0.05 millimeters to about 1.5 millimeters.

9. A heat transfer tube as in claim 1, wherein the top, bottom, and end walls are defined by a metal sheet having a first end portion and a second end portion, the first and second end portions connected to each other to define a conduit.

10. A heat transfer tube as in claim 9, wherein at least one of the first and second end portions extends across an interior of the conduit and contacts an inner surface of the metal sheet thereby strengthening the heat transfer tube against collapse.

11. A heat transfer tube as in claim 10, wherein the at least one of the first and second end portions extending across the conduit has a generally arcuate shape.

12. A heat transfer tube as in claim 10, wherein the first and second end portions both extend across the conduit and contact the inner surface of the metal sheet.

13. A heat exchanger for a vehicle comprising:

a core having a plurality heat transfer tubes extending between first and second ends of the core and defining a fluid flow path;

an inlet in fluid communication with the heat transfer tube; and an outlet in fluid communication with the heat transfer tube;

the heat transfer tube including:

opposing top and bottom walls; and end walls connecting the top and bottom walls to each other and being generally arcuate in shape, a plurality of deformations formed in the end walls to strengthen the heat transfer tube; and wherein the deformations extend around the end walls of the tube and into the top and bottom walls of the tube.

14. A heat exchanger as in claim 13, wherein the top, bottom, and end walls are defined by a metal sheet having a first end portion and a second end portion, the first and second end portions being connected to each other to define a conduit, and wherein at least one of the first and second end portions extends across the conduit and contacts an inner surface of the metal sheet.

15. A heat exchanger as in claim 13, wherein the deformations are generally linear and oriented at an angle between 30 and 60 degrees with respect to a longitudinal axis of the heat transfer tube.

16. A heat exchanger as in claim 13, wherein the deformations are generally linear and oriented at an angle between 120 and 150 degrees with respect to a longitudinal axis of the heat transfer tube.

17. A heat transfer tube for a heat exchanger, the heat transfer tube comprising:

opposing top and bottom walls, each of the top and bottom walls defining a substantially planar surface;

opposing end walls connecting the top and bottom walls to each other, each of the end walls defining a generally arcuate surface having a plurality of deformations formed therein, the deformations strengthening the heat transfer tube; and wherein the deformations protrude into the tube, thereby causing the tube height to vary through the cross-section of the tube.

18. A heat transfer tube for a heat exchanger, the heat transfer tube comprising:

opposing top and bottom walls, each of the top and bottom walls defining a substantially planar surface;

opposing end walls connecting the top and bottom walls to each other, each of the end walls defining a generally arcuate surface having a plurality of deformations formed therein, the deformations strengthening the heat transfer tube; and wherein the deformations protrude into the tube, thereby causing the tube height to vary through the length of the tube.

* * * * *